US006442473B1

(12) United States Patent
Berstis et al.

(10) Patent No.: US 6,442,473 B1
(45) Date of Patent: Aug. 27, 2002

(54) METHOD AND APPARATUS FOR PRESENTING TRAFFIC INFORMATION IN A VEHICLE

(75) Inventors: Viktors Berstis, Austin; Linda Arnold Lisle, Cedar Park, both of TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/239,330

(22) Filed: Jan. 28, 1999

(51) Int. Cl.[7] ..... G06G 7/76

(52) U.S. Cl. ..... 701/117; 701/211; 342/69; 340/905; 340/907

(58) Field of Search ..... 701/117, 118, 701/119, 200, 207, 211; 342/46, 57, 69; 340/901, 906, 907, 917, 919, 988, 905

(56) References Cited

U.S. PATENT DOCUMENTS 4,704,610 A * 11/1987 Smith et al. ..... 340/906
5,712,632 A * 1/1998 Nishimura et al. ..... 340/995
5,973,616 A * 10/1999 Grebe et al. ..... 340/825.69
6,008,741 A * 12/1999 Shinagawa et al. ..... 340/907

* cited by examiner

*Primary Examiner*—Yonel Beaulieu
(74) *Attorney, Agent, or Firm*—Duke W. Yee; Jeffrey S. LaBaw

(57) ABSTRACT

A method and apparatus for acquiring a traffic signal for presentation in a vehicular mounted display. A receiver is located on the vehicle for receiving a traffic message from a traffic signal proximate to a vehicle. The vehicle includes a location and direction determining systems for determining a location and direction of the vehicle. A decoding systems is present for decoding the traffic message. A selection systems is used for determining an appropriate traffic signal display for the vehicular mounted display according to the location and direction of the vehicle relative to the traffic signal. The traffic signal display is displayed on a display in the vehicle.

34 Claims, 4 Drawing Sheets

Figure 3
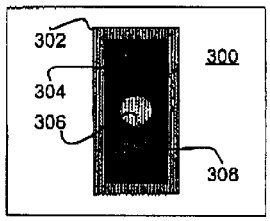
Figure 3A
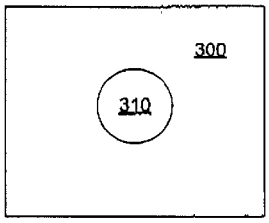
Figure 3B
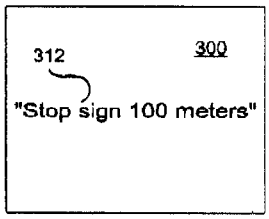
Figure 3C
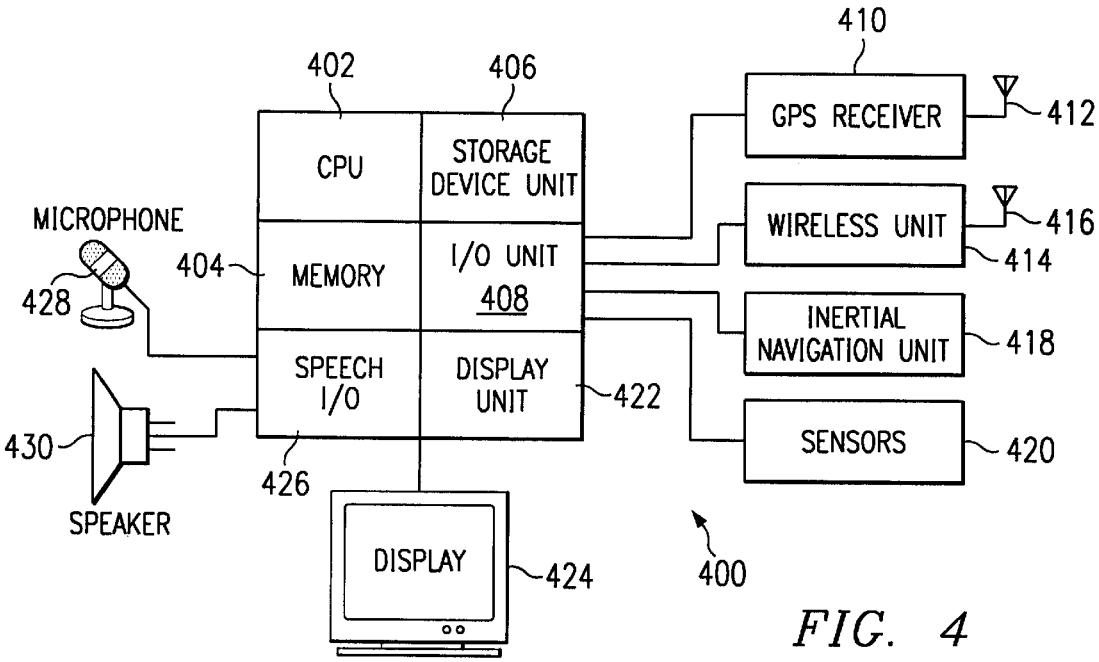
FIG. 4

METHOD AND APPARATUS FOR PRESENTING TRAFFIC INFORMATION IN A VEHICLE

BACKGROUND OF THE INVENTION

1. Technical Field

The present invention relates generally to an improved data processing system and in particular to a data processing system located within a vehicle. Still more particularly, the present invention relates to a method and apparatus for presenting traffic information to a driver in a vehicle.

2. Description of Related Art

The use of computers has become more and more pervasive in society. This pervasiveness includes the integration of personal computers into vehicles. The utilization of computer technology is employed to provide users or drivers with a familiar environment. In this manner, a user's ability to easily use computing resources in an automobile is provided. In addition, it is envisioned that car buyers would be able to use most of the same software elements in an automobile that are used at home or in the office. Further, an automobile owner could completely customize driver information displays to create an optimal environment for the driver's needs. Various platforms have been developed and are being developed for use in automobiles. Many platforms provide the computing strength of a personal computer platform with widely recognized as well as emerging technologies. Widely accepted technologies that may be implemented within an automobile include, cellular/global system for mobile communications (GSM), global positioning system (GPS), and radio data broadcast (RDB). These devices allow a driver to navigate, receive real-time traffic information and weather forecasts, access databases of personalized information, and place and receive telephone calls, as well as send and receive email and faxes from an automobile. Emerging technologies that are being integrated into computing platforms for automobiles include the universal serial bus (USB) and the digital video disk (DVD).

Another key feature for adapting computer technologies for use in an automobile is a voice recognition interface (VUI) for the driver along with a more conventional graphical user interface (GUI) for passengers. Voice recognition technology is already well developed in multi-media desktop personal computers. For example, VoiceType family products available from International Business Machines Corporation may be also used in the automobile. Voice recognition technology would allow drivers to easily control and interact with onboard computers and telephone applications, including productivity software, internet browsers, and other applications while allowing the driver to keep their hands on the wheel and their eyes on the road. Such productivity is especially important when some surveys show that up to twelve percent of a person's waking life is spent in an automobile.

With all of this emerging technology, however, a problem still exits with seeing obscured traffic signals, such as traffic lights or stop signs. Traffic signals may occur in all kinds of locations and are not always located where they may be expected. Sometimes the traffic signals may be obscured by tree branches or weather conditions, such as fog or heavy rain. Other times, the traffic signal may be located some distance around a curve. In these situations, the presently available navigation systems normally do not include details such as traffic signals and the state of the traffic signals. In addition, the maps provided would be hard to update to identify each new traffic signal and changes in traffic signal locations and types. For example, stop signs at a four way stop sometimes are replaced with a signal light depending on the amount of traffic and the plan for the particular intersection. It would be useful to know what type of traffic signal is present prior to being able to see the traffic signal visually. This is especially useful when light or weather conditions limit visibility. For example, it would be useful to know where a traffic light is located and the state of a traffic light in foggy weather as one approaches such a traffic signal.

Therefore, it would be advantageous to have an improved method and apparatus for identifying traffic signals and presenting them to a driver in a vehicle.

SUMMARY OF THE INVENTION

The present invention provides a method and apparatus for acquiring a traffic signal for presentation in a vehicular mounted display. A receiver is located on the vehicle for receiving a traffic message from a traffic signal proximate to a vehicle. The vehicle includes a location and direction determining means for determining a location and direction of the vehicle. A decoding means is present for decoding the traffic message. A selection means is used for determining an appropriate traffic signal display for the vehicular mounted display according to the location and direction of the vehicle relative to the traffic signal. The traffic signal display is displayed on a display in the vehicle.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIGS. 3A–3C are diagrams of presentations of traffic signals to a driver in a vehicle illustrated in accordance with a preferred embodiment of the present invention;

FIG. 4 is a block diagram of an automotive computing platform in accordance with a preferred embodiment of the present invention;

DETAILED DESCRIPTION OF THE PREFERRED EMBODIMENT

The present invention provides a method, apparatus, and instructions for presenting traffic information to a driver of a vehicle. The mechanism of the present invention provides a presentation of traffic signals to a driver within a vehicle. The term traffic signal as used herein refers to any type of signal used to control traffic. For example, a traffic signal includes fixed traffic signs, such as stop signs, yield signs, construction warning signs, crossing signs, and speed limit signs. A traffic signal also includes all types of signal lights. Traffic lights at intersections are usually computer controlled and may be augmented with a transmitter that broadcasts the state of the traffic light to approaching vehicles. The mechanism of the present invention may signal when a traffic light will soon change to red to warn the driver to start slowing down.

Figure 1:
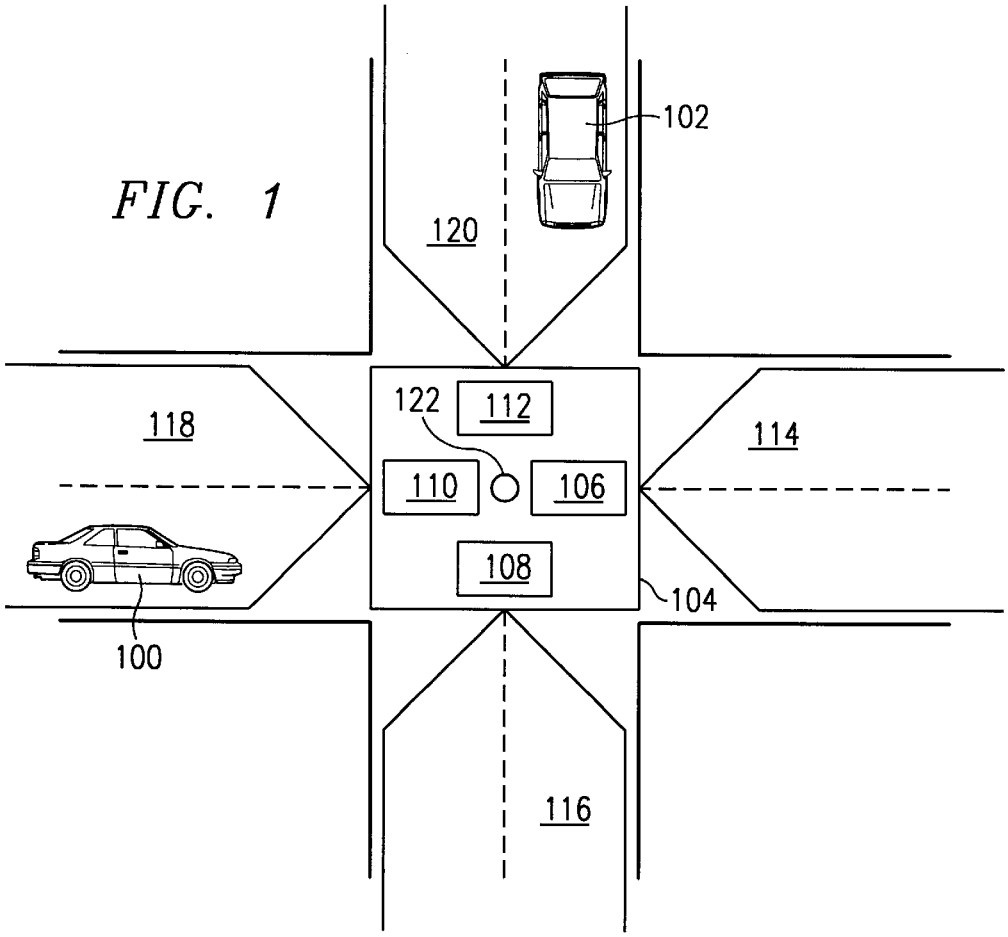
FIG. 1 is a diagram of a traffic signal presentation system in accordance with a preferred embodiment of the present invention.

With reference now to the figures and in particular with reference to FIG. 1, a diagram of a traffic signal presentation system is depicted in accordance with a preferred embodiment of the present invention. In this illustration, vehicle 100 and vehicle 102 are approaching a traffic signal in the form of a signal light 104.

In this example, signal light 104 includes transmitters 106, 108, 110, and 112. These transmitters are directional transmitters that transmit radio frequency signals in this example in fields 114, 116, 118, and 120. The signal also could be an infrared signal depending on the implementation. In the depicted example, transmitters 106, 108, 110, and 112 transmit traffic messages that are received by vehicles approaching signal light 104. Signal light 104 also includes a receiver 122 used to receive signals from vehicles, such as vehicles 100 and 102. Alternatively, transceivers may be used in place of transmitters 106, 108, 110, and 112 and receiver 122. In some cases, the signals generated by the transmitters need not be directional. This is true in the instance in which a vehicle has a global positioning system or a compass with a directional receiver. The transmitter transmitting the information about the traffic signal would be non-directional. In the instance in which the traffic signal is a signal light, the information sent could include data about the direction of the signal light and the state of the signal light for each facing of the signal light. With the global positioning system or a compass with a directional receiver, the location and relevant state information may be identified. In the case in which the vehicle contains a compass and a directional receiver, a vehicle moving away from the signal light would not receive the transmitted information. A vehicle approaching the signal light would receive the transmitted information and could identify the facing pertinent to the vehicle based on directional information obtained from the compass. Additionally, the transmitter need not be located at or on the signal itself, but may be placed in a location chosen for maximum effectiveness in transmitting information about the traffic signal.

Figure 2:
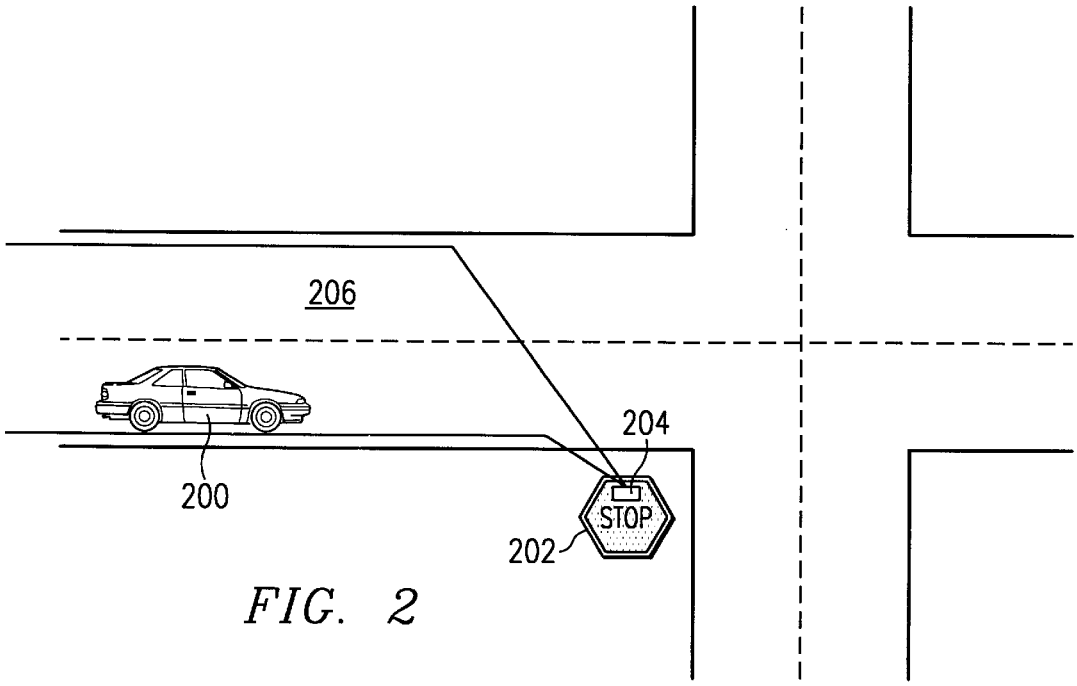
FIG. 2 is a diagram of a fixed traffic signal system in accordance with a preferred embodiment of the present invention.

Turning now to FIG. 2, a diagram of a fixed traffic signal system is depicted in accordance with a preferred embodiment of the present invention. In this example, vehicle 200 is approaching a stop sign 202, which has a transmitter 204 that emits traffic messages in a field 206. Transmitter 204 is a directional transmitter in this example such that the traffic messages are received only by vehicles approaching stop sign 102 from the appropriate direction. In other cases, non-directional transmitters may be used. For example, signs warning of construction may use non-directional transmitters to warn traffic approaching from all directions. Further, a stop sign or a intersection with four way stop signs need not use directional transmitters and need not transmit directional information. Although the depicted example is that of a stop sign, the present invention may be applied to all types of fixed traffic signals, such as, for example, speed limit signs, yield signs, and construction signs.

With reference next to FIGS. 3A–3C, diagrams of presentations of traffic signals to a driver in a vehicle are illustrated in accordance with a preferred embodiment of the present invention. In FIG. 3A, a display 300 is used to present a traffic signal, such as signal light 302. In this example, signal light 302 is presented as an illustration of a signal light with lights 304, 306, and 308. Depending on the state of the signal light represented by signal light 302, one of lights 304, 306, and 308 will be highlighted. For example, if the actual signal light is green, then signal light 302 will be displayed within display 300 with light 308 being presented using the color green. Alternatively, a single light, such as light 310 may be displayed in display 300 as shown in FIG. 3B. Light 310 may be displayed with an appropriate color to indicate a condition of the signal light. For example, if the signal light is red, then light 310 would be displayed with a red color to indicate to the driver that the driver is approaching a red signal light.

In addition, display 300 may be used to present traffic signals that are fixed. For example, if the driver is approaching a stop sign, text may be displayed to the driver. Alternatively, when approaching a stop sign, the presentation of the traffic signal may be in the form of a flashing red light on a display, rather than text. In FIG. 3C, the text "stop sign 100 meters" is presented to the driver in display 300 as text 312 to indicate that the driver is approaching a stop sign that is located 100 meters ahead. Alternatively, an image of a stop sign may be displayed to the driver in place of text depending on the implementation. Further, traffic signals may be presented to the driver using audio in place of the visual display or with a combination of audio and video. For example, an audio message may be presented to the driver, such as "you are approaching a green traffic light". Alternatively, a series of tones may be used to prompt or alter the driver to changes in a traffic signal, such as a traffic light. For example, a tone may be used to indicate to the driver that a light has turned green when the driver has been waiting at a traffic light for a period of time.

Turning next to FIG. 4, a block diagram of an automotive computing platform is depicted in accordance with a preferred embodiment of the present invention. Computing platform 400 is located within a vehicle, such as an automobile or truck. Computing platform 400 includes a CPU 402, which may be an embedded processor or processor such as a Pentium processor from Intel Corporation. "Pentium" is a trademark of Intel Corporation. Computing platform 400 also includes memory 404, which may take the form of random access memory (RAM) and/or read only memory (ROM).

Computing platform 400 also contains a storage device unit 406. Storage device unit 406 may contain one or more storage devices, such as, for example, a hard disk drive, a flash memory, a DVD drive, or a floppy disk. Storage device unit 406 may contain a database, which may include information about existing traffic signals, such as, for example, stop signs. In such a case, no need exists to request such information from a remote server. Computing platform 400 also includes an input/output (I/O) unit 408, which provides connections to various I/O devices. In this example, a GPS receiver 410 is included within computing platform 400 and receives signals through antenna 412. Wireless unit 414 provides for two-way communications between computing unit 400 and another data processing system, such as signal light 104 in FIG. 1. Communications are provided through antenna 416.

In addition, inertial navigation unit 418 is connected to I/O unit 408. Inertial navigation unit 418 is employed for navigation when GPS receiver 410 is unable to receive a usable signal or is inoperable.

A multitude of different sensors 420 also are connected to I/O unit 408. These sensors may include, sensors that detect speed, unusually high acceleration forces, airbag deployment, extensive speed up and slow down cycles, dropping out of cruise control, brake use, anti-lock brake occurrences, traction control use, windshield wiper use, turning on or off of lights for the automobile, and outside light levels. In the depicted example, sensors 420 will include a compass, which may be used to identify the direction in which a vehicle is travelling. Almost any condition or parameter about or around an automobile may be detected through the use of sensors 420.

Computing platform 400 also includes a display adapter 422, which is connected to display 424. In the depicted example, this display is a touch screen display. Alternatively or in addition to a touch screen display, display 424 also may employ a heads-up display projected onto the windshield of the automobile. Computing unit 400 also includes a microphone 428 and a speaker 430 to provide a driver with an ability to enter commands and receive responses through speech I/O 426 without having to divert the driver's attention away from the road, or without the driver having to remove the driver's hands from the steering wheel.

Figure 5:
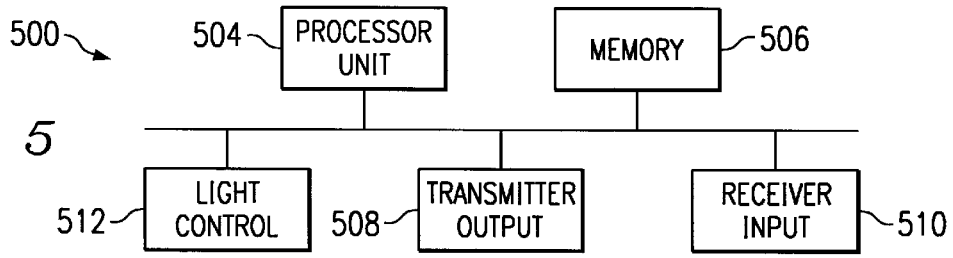
FIG. 5 is a block diagram of a traffic signal computing system in accordance with a preferred embodiment of the present invention.

With reference now to FIG. 5, a block diagram of a traffic signal computing system is depicted in accordance with a preferred embodiment of the present invention. Traffic signal computing system 500 is an example of a computing system that may be implemented within a traffic signal, such as signal light 104 in FIG. 1.

Traffic signal computing system 500 includes a bus 502. Processor unit 504, memory 506, transmitter output 508, receiver input 510, and light control 512 are attached to bus 502. Processor unit 504 executes instructions to perform various functions. For example, processor unit 504 will process instructions to control light cycles using light control 512. In addition, processor unit 504 will transmit traffic messages through transmitter output 508, which is configured to be connected to a transmitter, such as transmitters 106, 108, 110, or 112 in FIG. 1. In addition, processor unit 504 may process messages received from a vehicle using receiver input 510, which is configured to be connected to a receiver 122 in FIG. 1. Of course, the transmitter and receiver may be implemented as a transceiver. In this case, transmitter output 508 and receiver input 510 would be connected to the transceiver.

Memory 506 is used to store instructions and data for traffic signal computing system 500. Memory 506 may take various forms depending on the implementation. For example, memory 506 may be a random access memory, a read only memory, or a storage device, such as a hard disk drive.

Traffic signal computing system 500 is illustrated in a configuration for use in a signal light, such as signal light 104 in FIG. 1. This system may be used in other traffic signals, such as a stop sign. In such an implementation, the components in traffic signal computing system 500 may vary. For example, when used with a stop sign, light control 512 is unnecessary as well as receiver input 510. When used with a stop sign, traffic signal computing system 500 might only transmit an indication that the stop sign is present.

One mechanism for transmitting information to and from a signal light may be found in U.S. patent application, Ser. No. 09/239,253, filed even data hereof, entitled "Time Multiplexed Global Positioning System For Control of Traffic Lights", which is incorporated herein by reference.

The present invention provides a method, apparatus, and instructions for presenting traffic information to a driver of a vehicle. This traffic information may be presenting in a number of different ways. The traffic information may be displayed on display, such as display 424 in FIG. 4. Alternatively, the presentation may be presented through speaker 430 in FIG. 4. The audible presentation may take different forms, such as, for example, a verbal presentation such as "Approaching a green signal light" or a tone to indicate a traffic signal is being approached by the vehicle.

Figure 6A:
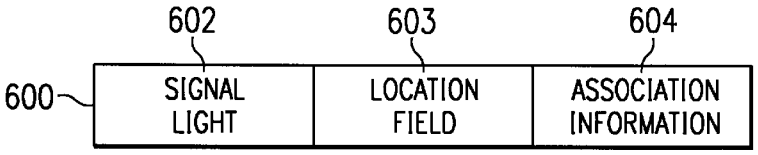
FIGS. 6A–6D are examples of messages used in presenting traffic signals in accordance with a preferred embodiment of the present invention.

Turning now to FIGS. 6A–6D, examples of messages used in presenting traffic signals is depicted in accordance with a preferred embodiment of the present invention. In FIG. 6A, traffic message 600 is an example of a traffic message that might be sent from a signal light to a vehicle. Traffic message 600 includes a traffic signal identification field 602, a location field 603, and an associated information field 604. Traffic signal identification field 602 includes the identification of the traffic signal type. Location field 603 contains the location of the traffic signal. This information may be, for example, the longitude and latitude of the traffic signal.

In this example, the traffic signal type is a signal light. Associated information field 604 contains information about the traffic signal. In this case, associated information field 604 indicates that the signal light is green. Other information also may be included in associated information field 604. For example, an indication that the signal is about to change from green to red also may be included within associated information field 604.

Figure 6B:
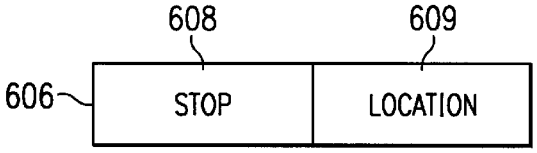
Figure 6C:
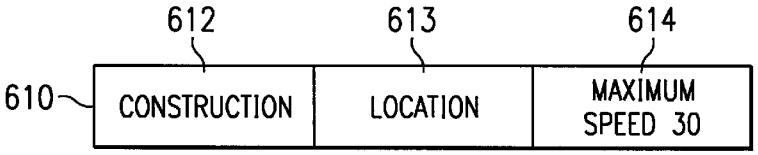

Next in FIG. 6B, traffic message 606 only includes a traffic identification field 608 and a location field 609. In this instance, traffic identification field 606 identifies the traffic signal type as being a stop sign. In FIG. 6C, traffic message 610 identifies the traffic signal type as being a construction warning sign within traffic signal identification field 612. Also included in traffic message 610 is location field 613 and associated information field 614. Associated information field 614 indicates that a maximum speed of 30 miles per hour should be observed.

Figure 6D:
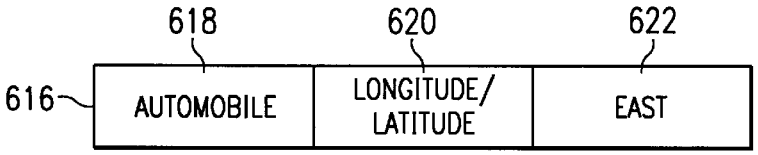

In FIG. 6D, a vehicle message 616 is used to send information to a traffic signal. Vehicle message 616 includes a vehicle identification field 618, a location field 620, and a direction field 622. Vehicle identification field 618 is used to identify the vehicle type. In the depicted example in FIG. 6D, the vehicle type is an automobile as shown in vehicle identification field 618. This identification of the vehicle type may be used to alter the traffic signal pattern for a signal light. For example, if the vehicle type is an emergency vehicle, indicating an emergency situation, the traffic pattern may be altered to allow the emergency vehicle to pass.

Vehicle message 616 also includes a location field 620 and a direction field 622. Location field 620 identifies the location of the vehicle originating vehicle message 616. This information may take the form of longitude and latitude information. The direction that the vehicle is traveling is indicated in direction field 622. In this example, the vehicle is traveling east.

Figure 7:
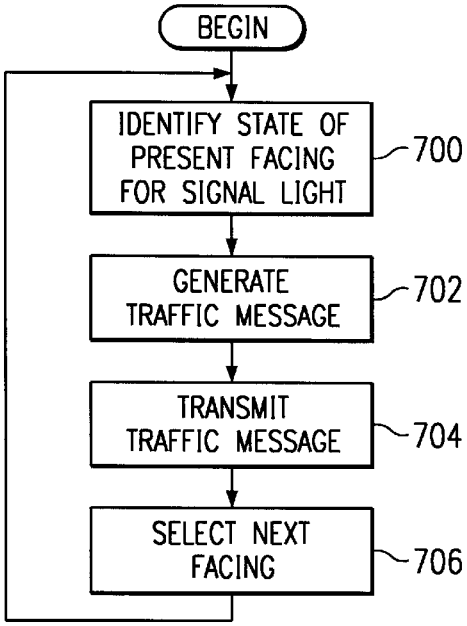
FIG. 7 is a flowchart of a process used by a traffic signal to transmit traffic messages in accordance with a preferred embodiment of the present invention.
Figure 8:
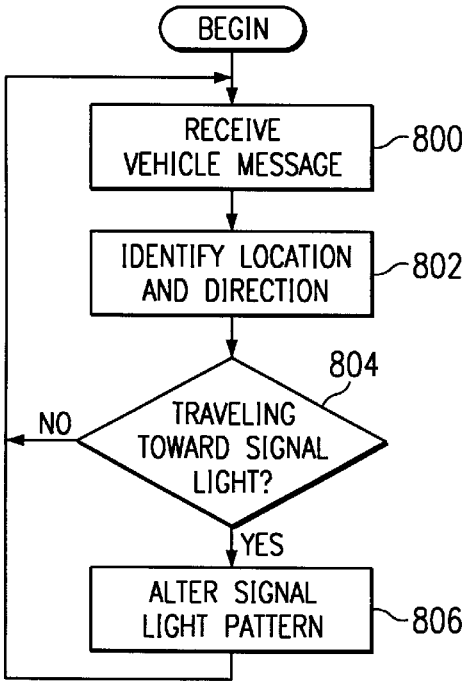
FIG. 8 is a flowchart of a process employed by a traffic signal to alter traffic signal patterns in accordance with a preferred embodiment of the present invention.

With reference next to FIG. 7, a flowchart of a process used by a traffic signal to transmit traffic messages is depicted in accordance with a preferred embodiment of the present invention. In this flowchart, the steps are those followed by a traffic signal that is a signal light. The process begins by identifying the state of the present facing for the signal light (step 700). The process will generate traffic messages for each facing of a signal light so that the appropriate traffic message is generated for oncoming traffic from different directions. In this example, the signal light has three states, stop, caution, and go, which are physically indicated by the signal light through the use of a red light, a yellow light, and a green light, respectively. A traffic message is generated for the present facing (step 702). This step involves generating a traffic message, such as traffic message 600 in FIG. 6A. Thereafter, the traffic message is transmitted (step 704). In the depicted example, the traffic message is transmitted through a directional transmitter associated with the present facing such that only vehicles approaching that facing will receive the traffic message. The next facing is selected to be the present facing after transmission of a traffic message (step 706) with the process then returning to step 700. Turning now to FIG. 8, a flowchart of a process employed by a traffic signal to alter traffic signal patterns is depicted in accordance with a preferred embodiment of the present invention. In this example, the traffic signal is a signal light. The process begins by receiving a vehicle message (step 800). This message may be received through a receiver, such as receiver 122 in FIG. 1. Thereafter, the location and direction of the vehicle is identified (step 802). Based on this identification, a determination is made as to whether the vehicle originating the vehicle message is traveling towards the signal light (step 804). If the vehicle is not traveling towards a signal light, the process returns to step 800. Otherwise, the signal light pattern is altered (step 806) with the process then returning to step 800.

In this example, the signal light pattern is altered in response to a vehicle approaching the signal light regardless of the vehicle type. The altering of the signal light pattern in step 806 may depend on the number of vehicles approaching the signal light and from which direction the vehicle are approaching. In addition, the signal light pattern altering performed in step 806 may take into account the vehicle type, giving preference to emergency vehicles in emergency situations.

Figure 9:
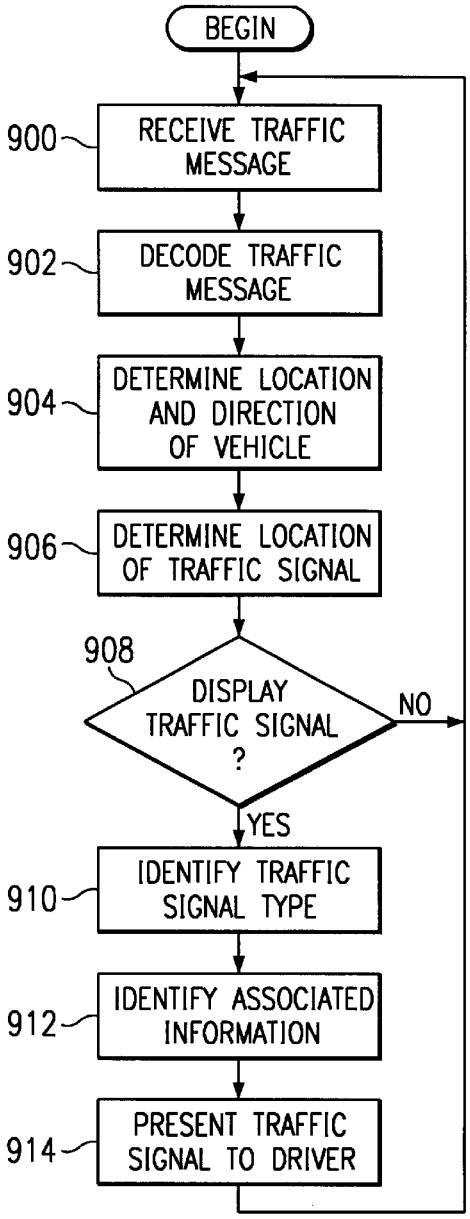
FIG. 9 is a flowchart of a process used in a computing platform within a vehicle to present traffic signals to a driver in accordance with a preferred embodiment of the present invention.

Turning now to FIG. 9, a flowchart of a process used in a computing platform within a vehicle to present traffic signals to a driver is depicted in accordance with a preferred embodiment of the present invention. The process begins by receiving a traffic message (step 900). Thereafter, the traffic message is decoded (step 902). A determination of the location and direction of the vehicle also is made (step 904). This determination may be made through information gathered from a GPS receiver, such as GPS receiver 410 in the computing platform 400 in FIG. 4.

Alternatively, if the vehicle has a compass and a directional receiver, the directional information may be generated from the compass, rather than using information based on data received from GPS receiver 410. In this instance, the signal light would send a traffic message containing information about each facing of the signal light and the state of each facing of the signal light, such as whether the light in a particular facing is red, green, or yellow. In addition, information about the angle for a particular facing may be included such that the computing system of the vehicle can identify the relevant facing using this information along with the direction information obtained from the compass, identifying the direction in which the vehicle is traveling.

Thereafter, the location of a traffic signal is determined (step 906). This determination is made using location information, such as the longitude and latitude of the traffic signal identified from location information within the traffic message found in the location field in the traffic message. A determination is then made as to whether to display a traffic signal to the driver (step 908). The location and direction information of the vehicle and the traffic signal is used as part of this determination. If the vehicle is moving away from the traffic signal, the traffic signal will not be displayed in this implementation.

If the traffic signal is not to be displayed, the process returns to step 900. Otherwise, the traffic signal type is identified (step 910). This information may be obtained from the traffic signal identification field in the traffic message. Information associated with the traffic signal type, if any, is then identified (step 912). Thereafter, the traffic signal is presented to the driver (step 914) with the process then returning to step 900. The actual presentation of the traffic signal will depend on the traffic signal type and on the selected form of presentation. Examples of some possible types of presentations are described with reference to FIGS. 3A–3C.

Figure 10:
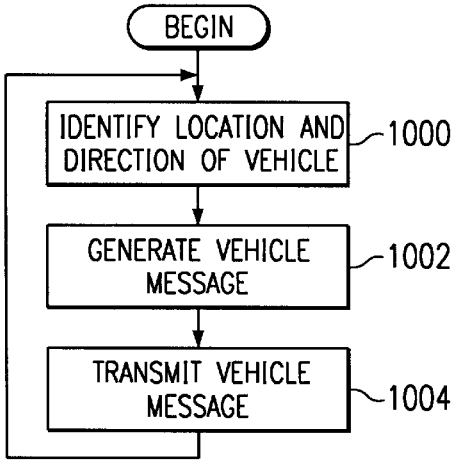
FIG. 10 is a flowchart of a process for generating a vehicle message in accordance with a preferred embodiment of the present invention.

In FIG. 10, a flowchart of a process for generating a vehicle message is depicted in accordance with a preferred embodiment of the present invention. This process is used to generate a vehicle message, such as vehicle message 616 in FIG. 6D. The process begins by identifying the location and direction of the vehicle (step 1000). Thereafter, a vehicle message is generated (step 1002), and then the vehicle message is transmitted (step 1004) with the process then returning to step 1000.

Traffic signals also may include other vehicles. For example, the mechanism of the present invention may be used to respond to other vehicles through receiving vehicle messages from these vehicles or by identifying vehicle with collision avoidance systems. For example, when a first driver is traveling along a road on which a second driver is backing out of a driveway onto the road, the vehicle in the driveway may signal its actions to the oncoming traffic. A presentation may be made to the first driver by having an in-dash yellow traffic light blinking to warn that someone may be entering the roadway ahead of the first driver.

Further, through the navigation system provided by the computing system within the vehicle, a database may be maintained of location of traffic signals, including those without transmitters. In this manner, a driver also can be warned of upcoming traffic signals being present even if the state of these signals is unknown.

It is important to note that while the present invention has been described in the context of a fully functioning data processing system, those of ordinary skill in the art will appreciate that the processes of the present invention are capable of being distributed in the form of a computer readable medium of instructions and a variety of forms and that the present invention applies equally regardless of the particular type of signal bearing media actually used to carry out the distribution. Examples of computer readable media include recordable-type media such a floppy disc, a hard disk drive, a RAM, and CD-ROMs and transmission-type media such as digital and analog communications links.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A system for acquiring a traffic signal for presentation in a vehicular mounted display comprising:

a receiver for receiving a traffic message from the traffic signal proximate to a vehicle;

location and direction determining means for determining a location and direction of the vehicle;

decoding means for decoding the traffic message;

means for determining an appropriate traffic signal display for the vehicular mounted display according to the location and direction of the vehicle relative to the traffic signal; and the vehicular mounted display for displaying the traffic signal display;

wherein the traffic signal conveys driving rules to drivers.

2. A system for acquiring a traffic signal for presentation in a vehicular mounted display comprising:

a receiver for receiving a traffic message from the traffic signal proximate to a vehicle;

location and direction determining means for determining a location and direction of the vehicle;

decoding means for decoding the traffic message;

means for determining an appropriate traffic signal display for the vehicular mounted display according to the location and direction of the vehicle relative to the traffic signal;

the vehicular mounted display for displaying the traffic signal display;

a receiver at the traffic signal for receiving vehicular messages; and means, responsive to the reception of vehicle messages, for changing the traffic signal pattern.

3. The system of claim 1, wherein the traffic signal is a fixed traffic sign.

4. A method in a vehicle for displaying traffic signal information, the method comprising the computer implemented steps of.

receiving a traffic message from a traffic signal having a directional component; and displaying the traffic message on a display within the vehicle.

5. The method of claim 4 further comprising:

decoding the traffic message; and determining an appropriate display for the traffic message.

6. The method of claim 4, wherein the traffic signal is a signal light.

7. A method in a vehicle for displaying traffic signal information, the method comprising the computer implemented steps of:

receiving a traffic message from a traffic signal; and displaying the traffic message on a display within the vehicle, wherein the traffic message includes an indication of a state of the traffic signal.

8. A method in a vehicle for displaying traffic signal information, the method comprising the computer implemented steps of:

receiving a traffic message from a traffic signal; and displaying the traffic message on a display within the vehicle, wherein the traffic signal is a stop sign.

9. The method of claim 8, wherein the traffic message is an indication of a presence of the stop sign.

10. The method of claim 4, wherein the traffic signal is a speed limit sign.

11. A method in a vehicular computing platform for displaying traffic messages from a traffic signal in a vehicle, the method comprising the vehicular computing platform implemented steps of:

receiving a traffic message from a traffic signal;

determining an appropriate presentation for the traffic message; and responsive to determining an appropriate display for the traffic message, presenting the traffic message, according to the location and direction of the vehicle relative to the traffic signal, within the vehicle using the appropriate presentation.

12. The method of claim 11, wherein the appropriate presentation is on a display within the vehicle.

13. The method of claim 11, wherein the appropriate presentation is an audio presentation.

14. A data processing system in a vehicle for displaying traffic signal information, the data processing system comprising:

receiving means for receiving a traffic message from a traffic signal; and displaying means for displaying the traffic message on a display within the vehicle;

wherein the traffic signal conveys driving rules to drivers.

15. The data processing system of claim 14 further comprising:

decoding means for decoding the traffic message; and determining means for determining an appropriate display for the traffic message.

16. The data processing system of claim 14, wherein the traffic signal is a signal light.

17. A data processing system in a vehicle for displaying traffic signal information, the data processing system comprising:

receiving means for receiving a traffic message from a traffic signal; and displaying means for displaying the traffic message on a display within the vehicle, wherein the traffic message includes an indication of a state of the traffic signal.

18. A data processing system in a vehicle for displaying traffic signal information, the data processing system comprising:

receiving means for receiving a traffic message from a traffic signal; and displaying means for displaying the traffic message on a display within the vehicle, wherein the traffic signal is a stop sign.

19. The data processing system of claim 18, wherein the traffic message is an indication of a presence of the stop sign.

20. The data processing system of claim 14, wherein the traffic signal is a speed limit sign.

21. A data processing system in a vehicular computing platform for displaying traffic messages from a traffic signal in a vehicle, the data processing system comprising:

receiving means for receiving a traffic message from a traffic signal;

determining means for determining an appropriate presentation, the presentation includes elements determined according to the location and direction of the vehicle relative to the traffic signal, for the traffic message; and responsive to determining an appropriate display for the traffic message, presenting means for presenting the traffic message within the vehicle using the appropriate presentation;

wherein the traffic signal conveys driving rules to drivers.

22. The data processing system of claim 21, wherein the appropriate presentation is on a display within the vehicle.

23. The data processing system of claim 21, wherein the appropriate presentation is an audio presentation.

24. A computer program product in a computer readable medium in a vehicle for displaying traffic signal information, the computer program product comprising:

first instructions for receiving a traffic message from a traffic signal; and second instructions for displaying the traffic message on a display within the vehicle;

wherein the traffic signal conveys driving rules to drivers.

25. A computer program product in a computer readable medium in a vehicular computing platform for displaying traffic messages from a traffic signal in a vehicle, the computer program product comprising:

first instructions for receiving a traffic message from a traffic signal;

second instructions for determining an appropriate presentation for the traffic message, the presentation includes elements determined according to the location and direction of the vehicle relative to the traffic signal; and third instructions, responsive to determining an appropriate display for the traffic message, for presenting the traffic message within the vehicle using the appropriate presentation;

wherein the traffic signal conveys driving rules to drivers.

26. The system of claim 1, wherein the traffic signal proximate to the vehicle is a sign or means for directing a traffic behavior of drivers of vehicles which is at least in part visible to drivers of the vehicles, and the determining means determines the appropriate traffic signal display according to a traffic signal type of the proximate traffic signal.

27. The system of claim 1, wherein the determining means determines the appropriate traffic signal display according to a state of the traffic signal proximate to the vehicle.

28. The method of claim 4, wherein the traffic signal is proximate to the vehicle, and is a sign or means for directing a traffic behavior of drivers of vehicles which are at least in part visible to drivers of the vehicles.

29. The method of claim 5, wherein the determining step determines the appropriate traffic signal display according to a traffic signal type of the traffic signal proximate to the vehicle.

30. The method of claim 5, wherein the determining step determines the appropriate traffic signal display according to a state of the traffic signal proximate to the vehicle.

31. The method of claim 11, wherein the traffic signal is proximate to the vehicle, and is a sign or means for directing a traffic behavior of drivers of vehicles which are at least in part visible to drivers of the vehicles, and the determining step determines the appropriate traffic signal display according to a traffic signal type of the traffic signal proximate to the vehicle.

32. The method of claim 11, wherein the determining step determines the appropriate traffic signal display according to a state of the traffic signal proximate to the vehicle.

33. The method of claim 14, wherein the traffic signal is proximate to the vehicle, and is a sign or means for directing a traffic behavior of drivers of vehicles which are at least in part visible to drivers of the vehicles, and the determining step determines the appropriate traffic signal display according to a traffic signal type of the traffic signal proximate to the vehicle.

34. The method of claim 14, wherein the determining step determines the appropriate traffic signal display according to a state of the traffic signal proximate to the vehicle.

* * * * *